US009242155B1

(12) United States Patent
Lindsay et al.

(10) Patent No.: US 9,242,155 B1
(45) **Date of Patent: *Jan. 26, 2016**

(54) BARREL FOR A BAT ASSEMBLY AND BALL BAT

(71) Applicant: Vyatek Sports, Inc., Fountain Hills, AZ (US)

(72) Inventors: Howard Alvin Lindsay, Scottsdale, AZ (US); Richard S. Meitz, III, Phoenix, AZ (US)

(73) Assignee: Vyatek Sports, Inc., Fountain Hills, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/829,241

(22) Filed: Mar. 14, 2013

Related U.S. Application Data

(63) Continuation-in-part of application No. 13/741,100, filed on Jan. 14, 2013.

(60) Provisional application No. 61/631,858, filed on Jan. 13, 2012.

(51) Int. Cl.
*A63B 59/06* (2006.01)
*A63B 59/00* (2015.01)

(52) U.S. Cl.
CPC ..... *A63B 59/06* (2013.01)

(58) Field of Classification Search
CPC ..... A63B 59/06
USPC ..... 473/457, 519, 520, 564–568
See application file for complete search history.

(56) References Cited

U.S. PATENT DOCUMENTS

| | | | | |
|---|---|---|---|---|
| 1,499,128 | A * | 6/1924 | Shroyer, Jr. | 473/519 |
| 2,340,156 | A * | 1/1944 | Taylor et al. | 473/566 |
| 3,116,926 | A | 1/1964 | Owen et al. | |
| 3,697,069 | A * | 10/1972 | Merola | 473/566 |
| 3,963,239 | A | 6/1976 | Fujii | |
| 4,056,267 | A | 11/1977 | Krieger | |
| 5,094,453 | A * | 3/1992 | Douglas et al. | 473/566 |
| 5,961,405 | A * | 10/1999 | MacKay, Jr. | 473/566 |
| 6,146,291 | A | 11/2000 | Nydigger | |
| 6,383,100 | B2 * | 5/2002 | Pitsenberger et al. | 473/566 |
| 6,485,382 | B1 * | 11/2002 | Chen | 473/566 |
| 6,508,731 | B1 | 1/2003 | Feeney et al. | |
| 7,201,679 | B2 | 4/2007 | Nguyen | |
| 7,381,141 | B2 | 6/2008 | Van Nguyen | |
| 7,419,446 | B2 | 9/2008 | Nguyen | |

(Continued)

OTHER PUBLICATIONS

Non-Final Office Action dated May 9, 2014 for U.S. Appl. No. 13/741,100.

*Primary Examiner* — Mark Graham
(74) *Attorney, Agent, or Firm* — Law Offices of Damon L. Boyd. PLLC

(57) ABSTRACT

The present disclosure is directed to a barrel comprising cast metal, composite or plastic for use in a bat assembly; a bat assembly comprising a barrel portion, an end cap and a handle; and a ball bat. The barrel may have uniform wall thickness or may include structural elements disposed on an inner surface to improve stiffness and reduce weight. The barrel and bat may further comprise a weighted insert for an asymmetrical center of gravity, allowing controlled spin to be imparted on a struck ball based on the angular orientation of the bat.

10 Claims, 11 Drawing Sheets

(56) References Cited

U.S. PATENT DOCUMENTS

| | | | | |
|---|---|---|---|---|
| 7,867,114 | B2 * | 1/2011 | Sutherland et al. | 473/567 |
| 8,197,365 | B2 * | 6/2012 | Tokieda | 473/566 |
| 8,226,505 | B2 * | 7/2012 | Burger | 473/520 |
| 8,435,143 | B2 | 5/2013 | Vander Pol et al. | |
| 8,992,352 | B1 * | 3/2015 | Lindsay et al. | 473/566 |
| 2002/0072439 | A1 | 6/2002 | Feeney | |
| 2007/0202973 | A1 | 8/2007 | Van Nguyen | |
| 2007/0207882 | A1 * | 9/2007 | Van Nguyen | 473/564 |

* cited by examiner

BARREL FOR A BAT ASSEMBLY AND BALL BAT

CROSS-REFERENCE TO RELATED APPLICATIONS

This application is a Continuation-in-Part Application of U.S. Non-Provisional patent application Ser. No. 13/741,100, filed Jan. 14, 2013, entitled "VARIABLE LAUNCH CONTROL BAT," which claims priority to U.S. Provisional Patent Application Ser. No. 61/631,858, filed Jan. 13, 2012, entitled "NOVEL DESIGN AND PROCESS FOR HIGH-PERFORMANCE BAT DESIGNS, FEATURING VARIABLE LAUNCH CONTROL," both of which are incorporated herein by reference in their entireties.

FIELD OF INVENTION

The present disclosure is directed in general to sporting equipment, and more particularly, to a high-performance ball bat.

BACKGROUND OF THE INVENTION

Ball bats play an integral role in amateur, school, college and professional ball sports, such as baseball and cricket. Bats are generally made of metal, composites, or various combinations thereof. Bats can be monolithic (i.e., single material) in the barrel region, or multiwall in design (i.e., multiple materials). The history of metal bats is significant and can be traced to the early 1970's when the aluminum bat was first developed and commercialized. The National Collegiate Athletic Association (NCAA) approved aluminum bats in 1974 and aluminum has been the dominant metal bat material for decades.

Bats have generally been improved to increase the rebound velocity of the ball struck with the bat. Unlike wood bats, hollow aluminum or composite bats have variable barrel stiffness, defined as the hoop frequency. Reducing the hoop frequency of a bat equates to softening the barrel, resulting in an increase in batted ball speed. This can be accomplished by decreasing the wall thickness of the hollow bat and/or decreasing the stiffness of the barrel region of the bat. Stronger, albeit more expensive, metal alloys allowed bat designers to "thin-out" the impact zone without the bat denting, resulting in more of a trampoline effect and higher and higher performance. The historical trend in metal bats has been to thin out the metal wall, decrease stiffness, reduce hoop frequency and increase rebound velocity.

Recent changes have been implemented by various administrative bodies, such as the NCAA, limiting rebound velocity of ball bats for player safety. A new "Batted-Ball-Coefficient-Of-Restitution" (BBCOR) requirement went into effect for college players Jan. 1, 2011 and for high school players Jan. 1, 2012. The BBCOR standard replaced the previous "Ball-Exit-Speed-Ratio" (BESR) requirement, which had been in place for many years. The BBCOR requirement is a lower rebound velocity requirement than BESR, and meeting the BBCOR requirement means moving back down the rebound velocity versus barrel stiffness curve in the direction of wood bats (i.e., stiffer bats having lower rebound velocity). The new BBCOR requirement has thus hampered 40 years of innovation in "hotter bats" that trended toward maximizing rebound velocity through better alloys and more creative designs that decreased barrel stiffness.

The challenge today is to find ways to increase bat performance without increasing the weight of the bat. Presently, meeting the BBCOR requirement by simply increasing the wall thickness of a high-strength aluminum alloy bat, results in increased barrel weight and cost. The increase in barrel weight is particularly problematic in that it makes it more difficult for players to swing the bat fast, (and thus hit the ball further), and it adversely effects balance of the bat, making them feel heavy. Given these challenges, there is an ongoing need to design improved high-performance bats that meet the new BBCOR requirements while minimizing barrel weight and cost.

SUMMARY OF THE INVENTION

In general, the present disclosure is directed at a barrel for use in a bat; a bat assembly comprising a barrel portion, an end cap portion and a handle portion; and a ball bat. These bats may comprise cast metal and may have uniform or non-uniform wall thickness. In various embodiments, these bats can be non-metal, such as composite or plastic. The bats may comprise internal structural elements or features disposed around the inner surface for a non-uniform wall thickness. In various embodiments, the structural elements may comprise raised ribs disposed on an inner surface to improve specific characteristics of the bats such as stiffness at a reduced weight.

The present disclosure is also directed to an asymmetrically weighted bat. These bats may comprise a thicker wall segment bulging into the interior, or may include a weighted insert secured into a recess disposed into an outer surface, which shifts the center-of-gravity (CG) from the central axis out in the direction of the thicker wall segment or the weighted insert. The present disclosure also provides a method for a player in a ball sport to control the spin imparted on a struck ball, and consequently the flight of the struck ball, by holding the asymmetrically weighted bat in a particular angular orientation when striking the ball.

In various embodiments of the present disclosure, these bats can be monolithic or multiwall. In various embodiments, the bats can comprise aluminum, stainless steel, titanium, metal matrix composite (MMC), nickel, zinc, magnesium, composite or plastics. In various embodiments, the bats comprises cast metal. In various embodiments, these bats can be cast from any metal suitable for metal casting, or molded from any composite or plastic, or any combinations thereof. In various embodiments, low-cost cast technologies are used to produce these bats.

BRIEF DESCRIPTION OF THE DRAWINGS

The accompanying drawings are included to provide a further understanding of the disclosure and are incorporated in and constitute a part of this specification, illustrate embodiments of the disclosure, and together with the description serve to explain the principles of the disclosure, wherein.

DETAILED DESCRIPTION

Figure 1:
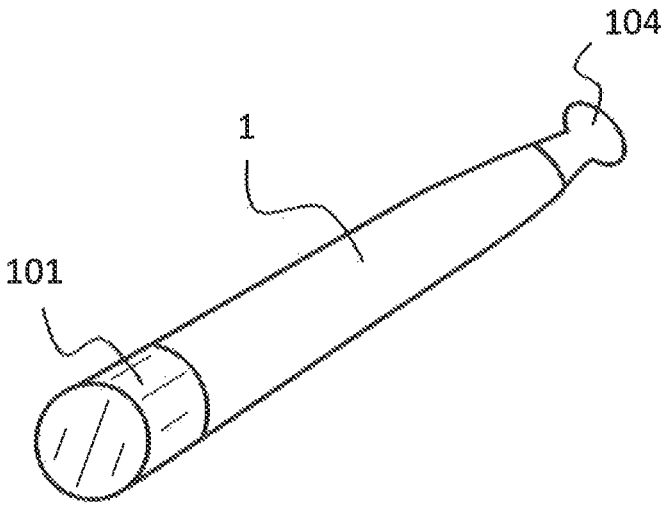
FIG. 1 illustrates a perspective view of an embodiment of a barrel with end caps in accordance with the present disclosure.

Persons skilled in the art will readily appreciate that various aspects of the present disclosure can be realized by any number of methods and systems configured to perform the intended functions. Stated differently, other methods and systems can be incorporated herein to perform the intended functions. It should also be noted that the accompanying drawing figures referred to herein are not all drawn to scale, but may be exaggerated to illustrate various aspects of the present disclosure, and in that regard, the drawing figures should not be construed as limiting. Finally, although the present disclosure can be described in connection with various principles and beliefs, the present disclosure should not be bound by theory.

In general, the present disclosure provides a barrel for use in a bat; a bat assembly comprising a barrel, an end cap portion and a handle portion; and a ball bat. In various embodiments, these bats may comprise metal, non-metal, or combinations thereof. The term non-metal as used herein means composite materials (e.g. graphite, glass, Kelvar®, and the like) or plastic. In various embodiments, the bats may comprise cast metal. As such, various embodiments of the present disclosure comprise a new design and construction of ball bats that use "non-conventional" metallic materials, namely cast metals. Casting a barrel for use in a bat, or casting an entire metal bat, opens up a multitude of enhancement features and different materials of construction for ball bats that are not possible with conventional wrought metals, or from the conventional processes generally used to make aluminum bats. For example, casting metal is done with less expensive metal alloys, casting is basically a low-cost, two-stage operation (casting molten metal and ejecting the cast metal object from the mold), casting allows for the molding of structural featuring both internally and externally, and casting allows the use of unconventional materials that cannot be put through conventional hot- and cold-metalworking processes.

Today, conventional aluminum bats are made by wrought materials and processes involving various combinations of extrusion, hot rolling, cold drawing, swaging and/or butting. Extrusion produces tubes from bar stock or ingots. Swaging is a rotary forming process that changes the diameter and/or shape of the tube. For example, rotary swaging using tapered swage dies can be used to create a taper on an aluminum tube. Butting is another process that changes the wall-thickness of a tube by pushing the metal tube through a die in a mandrel press, sinking the tube down into the mandrel, or by using an elaborate draw bench. The cold-working of metal generally aligns crystal grains to provide finished products of very high strength.

In various embodiments of the present disclosure, low-cost casting technologies are used to produce a barrel for a bat assembly, or an entire metal bat, with cast metal. This process can create the wall thickness profiles required for BBCOR standards and found in existing "wrought" aluminum bats, but at much lower costs. Although a cast metal object is typically not as strong as a wrought metal object due to the lack of crystal grain alignment from metal working, one way to meet the new BBCOR requirement in ball bats is to increase the wall-thickness of the bat. Using greater wall thickness in a bat design allows the use of lower specific strength materials.

Casting a hollow metal or non-metal object, as opposed to swage forming a metal tube, also allows for the introduction of internal structural details inside the cast metal object by casting the metal in a mold having a removable, dissolvable, or otherwise destroyable core with a pattern disposed on it. For example, a raised-rib structure, or other structural elements, can be cast on an inner surface to add stiffness at a reduced weight. In this way, a bat comprising cast metal can have the stiffness of a wrought metal bat without having an increased weight. The introduction of surface detail on the inner or outer surface of a cast barrel results in a barrel having a non-uniform wall thickness. However, provided the surface detail is symmetrically disposed around the inner and/or outer surface(s), these bats may remain symmetrically weighted with a center-of-gravity at the central axis. Asymmetrical weighting of a bat having a non-uniform wall thickness is still possible by the use of a weighted insert.

In various embodiments of the present disclosure, these bats may have a non-uniform wall thickness due to the presence of a thicker wall segment protruding into the inside, which also provides for unsymmetrical weighting.

Referring now to FIG. 1, a barrel 1 comprising cast metal in accordance with the present disclosure is illustrated. In various embodiments, the barrel 1 can comprise non-metals such as composites or plastics. In various embodiments, the barrel 1 may be modified into a bat through the addition of one or more other components (discussed below). The barrel 1 comprises a cavity inside to reduce weight. That is, the barrel 1 has a hollow interior. An inner surface defines the boundaries of the cavity. An outer surface of the barrel 1 may comprise regions where a person can grip and a region where a ball can be struck. The outer surface can be smooth and polished. The distance between the inner surface and the outer surface is the wall thickness of the barrel 1.

The inner surface of barrel 1 can be smooth, and the wall thickness of the barrel 1 can be generally uniform at any location. Alternatively, the inner surface of the barrel 1 may comprise at least one structural element that projects axially into, and/or radially out from, the cavity. With the presence of structural elements disposed on the inner surface of the barrel 1, the wall thickness is non-uniform. Structural elements disposed on the inner surface can comprise raised ribs that provide strength without the need for an overall thicker wall. As illustrated, the barrel 1 may include an end cap 101 and an end knob 104.

In various embodiments, barrel 1 comprises cast metal of any elemental metal or any alloy capable of being cast. For example, the barrel 1 may comprise cast aluminum, stainless steel, titanium, nickel, zinc or magnesium. In various embodiments, the barrel 1 may comprise cast aluminum, magnesium or titanium. In various embodiments, barrel 1 comprises cast aluminum. In various embodiments, barrel 1 is cast from any combination of aluminum alloys suitable for casting. In various embodiments, titanium, which today can be cast more cost effectively, can also be used. In various embodiments, barrel 1 comprises a composite. In various embodiments, barrel 1 comprises plastic.

In various embodiments, barrel 1 comprises "metal matrix composite" (MMC). As used herein, MMC means a composite material comprising a metal and a non-metal component, such as a ceramic or an organic material. MMC's are a class of materials that have never been applied to ball bats. Their high specific-stiffness levels would be ideally suited to new bat designs conforming to the BBCOR standards because the "stiffness" of these materials is generally better than conventional metals, although their strength is not. For embodiments of the barrel 1 having thicker wall thicknesses, materials such as aluminum oxide ($Al_2O_3$) or silicon carbide reinforced aluminum can yield more discretionary weight for a bat assembly that incorporates the barrel 1. In various embodiments, the MMC may comprise a metal alloy cast in the presence of synthetic or natural fibers. For example, fibers, such as carbon fibers, can be prepositioned in a mold prior to casting the barrel 1. Carbon fibers may be incorporated into cast aluminum to produce a high strength embodiment of barrel 1 comprising aluminum/carbon MMC.

The barrel 1 comprising cast metal may be cast inside any suitable temporary, semi-permanent or permanent mold typically used for casting metals or MMC. For example, sand molds, permanent molds or dies may be used for casting the barrel 1. As discussed, the barrel 1 is hollow, and therefore the casting or molding process generally requires a "core" to be used in the mold to create the cavity inside (discussed in more detail below).

Figure 2:
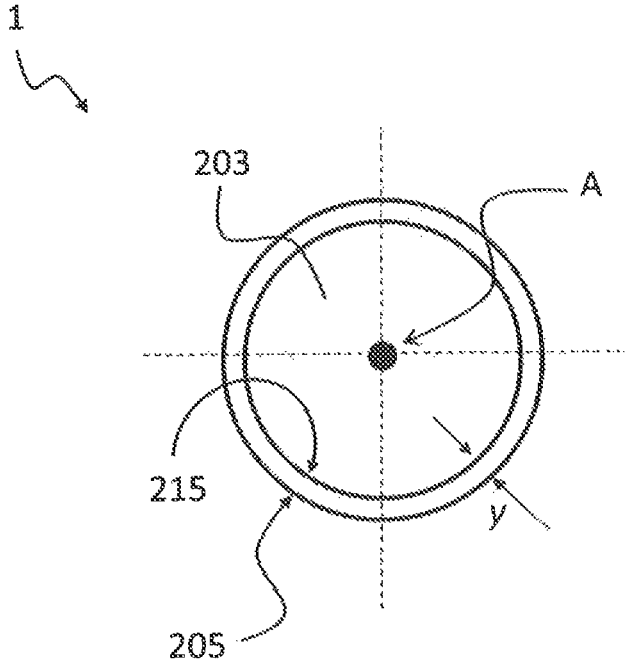
FIG. 2 illustrates a cross-sectional view of an embodiment of a barrel comprising a uniform wall thickness.

Referring now to FIG. 2, a cross section of an embodiment of a barrel 1 in accordance with the present disclosure is illustrated. The barrel 1 comprises a cavity 203. Barrel 1 further comprises inner surface 215 that is smooth and outer surface 205 that is smooth. The barrel 1 has uniform wall thickness y as shown. Due to the lack of structural elements on inner surface 215, and the round symmetry of the barrel 1, the center-of-gravity A is at the central axis of the barrel 1. Barrel 1 may comprise cast metal, non-metal materials, or combinations thereof.

Figure 3A:
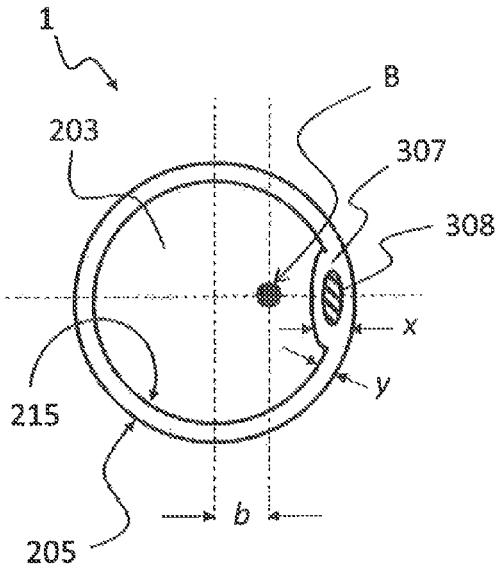
FIG. 3A illustrates a cross-sectional view of an embodiment of an asymmetrically weighted barrel comprising a thicker wall segment.

Referring now to FIG. 3A, an embodiment of an asymmetrically weighted barrel 1, having a non-uniform wall thickness, is illustrated. In FIG. 3A, barrel 1 comprises a non-uniform wall thickness due to the presence of a thicker wall segment 307 projecting into the cavity 203 of the barrel 1. For example, a thicker wall region may be incorporated in the wall of the barrel when casting a metal or molding a non-metal, such that the outer surface of the barrel or bat remains circular but the inner surface has a portion protruding axially into the cavity of the barrel or the bat. In this way, the asymmetry is permanently molded inside where it is tamper-proof and undetectable as to both its existence and the orientation that it is placed into during play.

As shown in FIG. 3A, barrel 1 comprises regions of thinner wall thickness y and regions of thicker wall thickness x, and thus it has a non-uniform wall thickness. The thicker wall segment 307 is a region of thicker material. In various embodiments comprising cast metal, a core having a small recess can be used during the casting process to create the thicker wall segment 307 in the cast metal. The thicker wall segment 307 may also comprise an encapsulated weight 308. In various embodiments, the encapsulated weight 308 can be of similar or different material than the barrel 1, and it can have any density. In this way, the encapsulated weight 308 can be as heavy as necessary while still maintaining any size restrictions. The encapsulated weight 308 can provide additional weight over what can be achieved just by thickening the wall of the barrel 1 at the thicker wall segment 307.

The presence of the thicker wall segment 307, (with or without the encapsulated weight 308) shifts the center-of-gravity of the barrel 1 off from the central axis over to position B by distance b, a position closer to the thicker wall segment 307. The distance b to which the center-of-gravity is shifted is dependent on the mass of the asymmetrical weighting, i.e., the weight of the added thickness in material at thicker wall segment 307 plus the mass of the encapsulated weight 308 if incorporated. The dimensions of the thicker wall segment 307 can vary, for example the thicker wall segment 307 can extend down a longitudinal length of the barrel 1 and it can extend circumferentially around the inner surface 215 of the barrel 1 to any degree (less than 360°) as needed.

In various embodiments, the thicker wall segment 307, and encapsulated weight 308, being internal to the barrel 1, may not be visible outside the barrel 1. That is, in various embodiments, the existence of asymmetrical weighting in the barrel 1 may not be noticeable to a casual observer. In various embodiments, there may be a marking or other indicia that allows the player to know where the asymmetrical weighting is located so that the player can orient the barrel 1 in a chosen angular rotation. By using a thicker wall segment on the inside of the barrel, mass distribution can be altered in a radial or circumferential direction, shifting the center-of-gravity of the bat without having the complexity and cost of a removable weight (discussed below with FIG. 3B).

Figure 3B:
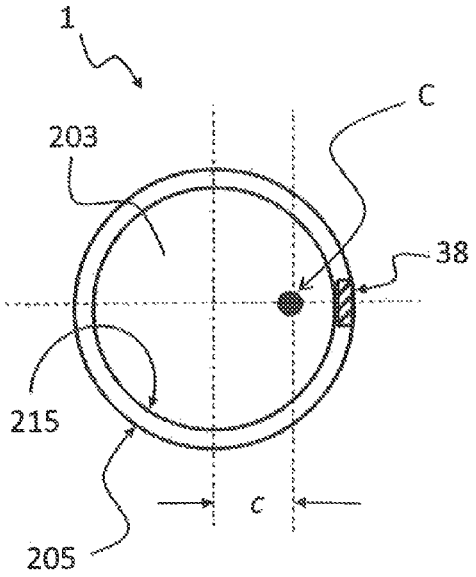
FIG. 3B illustrates a cross-sectional view of an embodiment of an asymmetrically weighted barrel comprising a weighted insert.

Referring now to FIG. 3B, another embodiment of asymmetrical weighting in accordance with the present disclosure is illustrated. Barrel 1 comprises an inner surface 215 that is smooth, and an outer surface 205 that is smooth. Without any structural elements disposed on the inner surface 215 or the outer surface 205, the barrel 1 in FIG. 3B has a uniform wall thickness. However, barrel 1 is asymmetrically weighted with a weighted insert 38 disposed in the wall of the barrel 1. The weighted insert 38 may be placed in a recess disposed on the outer surface 205 of the barrel 1. The presence of weighted insert 38 shifts the center-of-gravity of the barrel 1 off of the central axis by a distance c to a new position C that is closer to the weighted insert 38. The distance c to which the center-of-gravity is shifted is dependent on the mass of the asymmetrical weighting, i.e., the mass of the weighted insert 38 and any adjustment in weight due to the effect of the recess that holds the weighted insert 38. The weighted insert 38 may or may not be visible on the outside of the barrel 1. For example, the weighted insert 38 may sit flush with the outer surface 205 of the barrel 1 and may be of the same color in order to obscure its existence.

Figure 4:
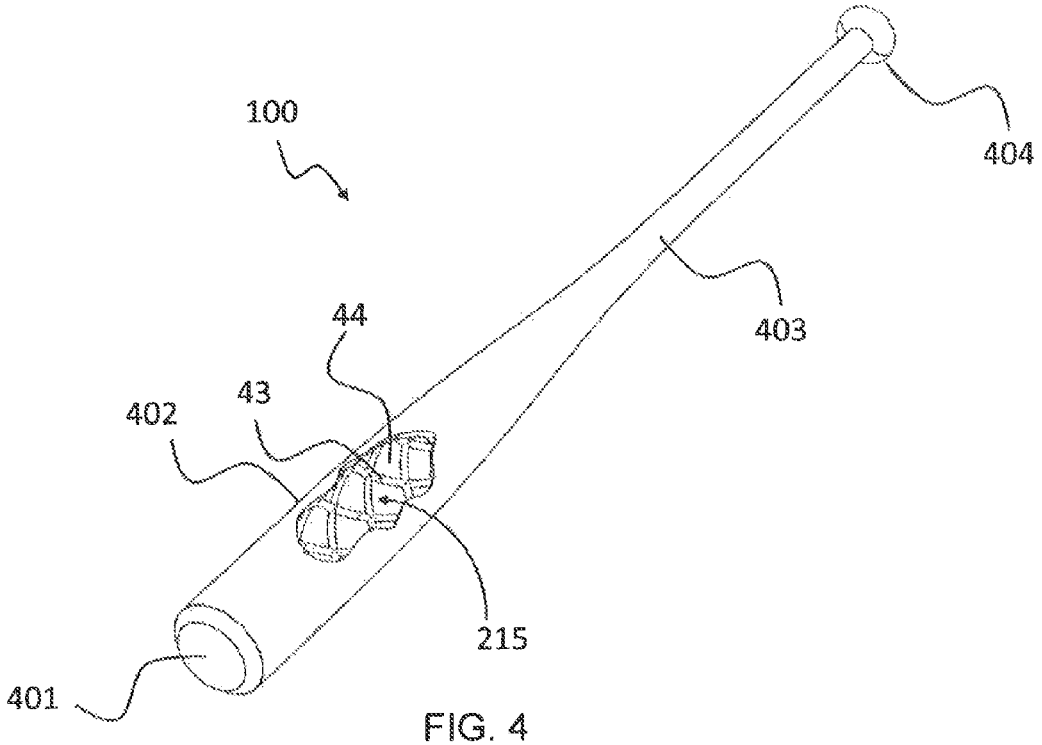
FIG. 4 illustrates a perspective view of an embodiment of a ball bat having a non-uniform wall thickness in accordance with the present disclosure.

Referring now to FIG. 4, the present disclosure is directed to a ball bat 100 having a hollow portion or cavity inside. A cavity may be molded or cast into the ball bat 100 such that ball impact region 402 is thin-walled rather than comprising solid metal or composite. In various embodiments, the cavity will be inside a majority of the ball impact region 402. The ball bat 100 comprises an inner surface 215 that defines the hollow portion inside the bat. In various embodiments, the inner surface 215 in the ball bat 100 comprises raised structural elements that project into the cavity. Raised structural elements can comprise at least one raised rib 43. In various embodiments, the raised structural elements on the inner surface 215 can be configured in any way that provides for structural improvements at reduced weight of the ball bat 100.

For example, raised structural elements may include criss-crossing rib networks, radially spaced circular ribs, one or more raised internal threads, and the like.

The presence of raised structural elements on the inner surface 215 of the ball bat 100 result in a non-uniform wall thickness. In various other embodiments, no structural elements are disposed on the inner surface 215, and thus the ball bat 100 has uniform wall thickness. In the embodiment illustrated in FIG. 4, ball bat 100 comprises a network of raised ribs 43, along with recessed interstices 44 located between the raised ribs 43. In other embodiments, the raised ribs 43 can be disposed in any pattern conducive to strengthening the ball bat 100. Depending on the weight, stiffness, strength and dynamics desired for the ball bat 100, the raised ribs 43 can be disposed to any height on the inner surface 215 of the ball bat 100. Additionally, the raised ribs 43 can be disposed to extend longitudinally or axially on the inner surface 215 as needed. In various embodiments, the raised ribs 43 may not cross at all. For example, the raised ribs 43 can comprise one continuous raised thread that winds through the ball bat 100 along the inner surface 215.

A dimensionally specific "core" is generally required when casting a metal object having an internal cavity. In various embodiments of the present disclosure, a core, used to create the hollow interior profile of the bat or barrel, can be patterned with recessed ribs that will ultimately produce the raised ribs 43 on the inner surface of the bat or barrel. In casting metal, the core is inserted into the mold prior to pouring in the molten metal, optionally held in place as needed by any number and design of chaplets. The molten metal flows and solidifies between the mold and the core to form the hollow cast metal object having the internal structure desired. After casting the metal, the core is removed, or destroyed by any number of destructive measures, to leave behind the desired internal structure inside the cast metal object.

In various embodiments of the present disclosure, the core can be unscrewed to leave behind a threaded raised rib, in which case the core can be reused. In other embodiments, the core may vaporize upon casting of the molten metal, shrink and breakup after the cast metal cools, or it may dissolve upon the addition of a solvent. Cores can be fabricated from, for example, various types of sand, sand aggregates, metals, polymers, plastics, Styrofoam, and the like, any of which can be coated with any combination of coatings such as graphite, silica or mica as needed.

Still referring to FIG. 4, and in addition to the ball impact region 402, the ball bat 100 further comprises an end cap region 401, a handle region 403, and an end knob region 404, any of which may be solid or hollow as needed for a particular bat. The end cap region 401, and/or the end knob region 404, may be contiguous with the ball impact region 402 or may be fabricated onto the ball bat 100 as required. Each of the described regions of the ball bat 100 may or may not be constructed from the same material. For example, the ball impact region 402 and handle region 403 may comprise a single casting of metal, whereas the end cap region 401 and the end knob region 404 may be composite or plastic material added on after casting the main body of the ball bat 100.

Figure 5:
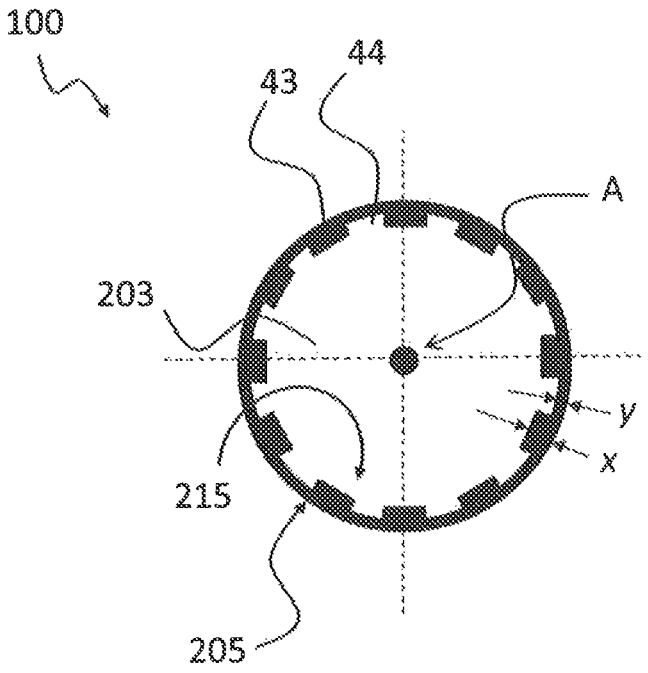
FIG. 5 illustrates a cross-sectional view of an embodiment of a symmetrically weighted bat having a non-uniform wall thickness.

Referring now to FIG. 5, a cross-sectional view of an embodiment of a ball bat 100, having structural elements disposed on the inner surface, is illustrated. As shown in FIG. 5, ball bat 100 comprises a cavity 103, an inner surface 215 and outer surface 205. A plurality of raised ribs 43 are disposed on the inner surface 215 that project into the cavity 203. Recessed interstices 44 are disposed between the raised ribs 43. The wall thickness x measured between any raised rib 43 and the outer surface 205 will be greater than the wall thickness measured between any recessed interstice 44 and the outer surface 205. As such, ball bat 100 has a non-uniform wall thickness. The plurality of recessed interstices 44 can be thought of as "removed metal." In other words, by having these recessed interstices 44, which are portions of thinner bat wall thickness, a ball bat 100 having lighter weight is achieved in comparison to a bat having a uniform wall thickness equal to x. In this way, the ball bat 100 is stiffened by the presence of the structural elements with concomitant reduction in weight.

Figure 6:
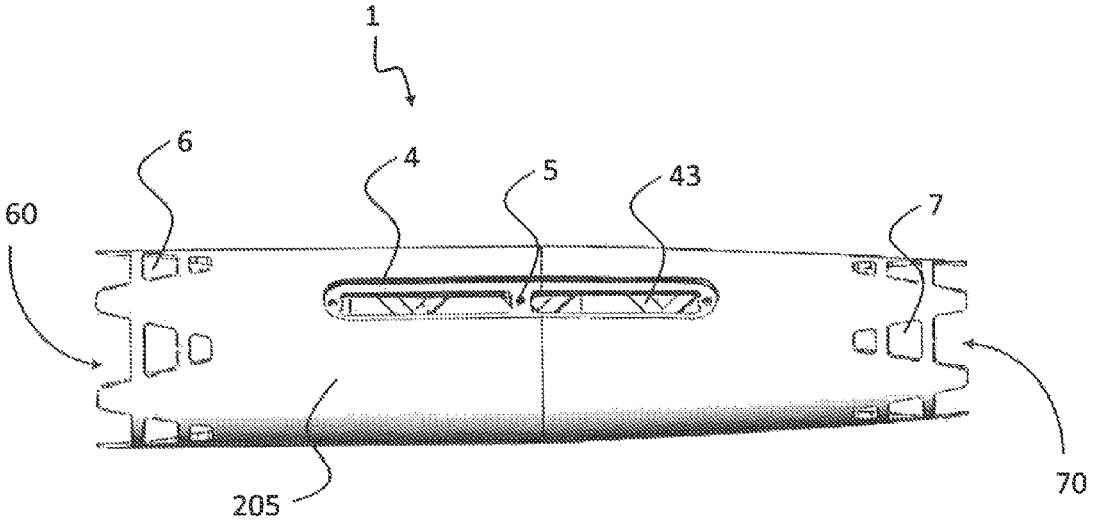
FIG. 6 illustrates a side view of an embodiment of a barrel in accordance with the present disclosure.

Referring now to FIG. 6, a barrel 1 in accordance with the present disclosure comprises a first open end 60 and a second open end 70. Barrel 1 may comprise cast metal as discussed above. The first end profile and second end profile are substantially circular, and thus the diameter of first open end 60 is greater than the diameter of the second open end 70, resulting in a taper to the barrel 1. In some embodiments, disposed on each end profile are structural features that assist in securely fastening the barrel 1 to other components at each open end, such as, for example, components that make up a bat assembly. In this way, the barrel 1 can comprise, at least in part, the ball impact region discussed above. For example, first open end 60 can comprise at least one first end aperture 6 that can accept a similarly sized protrusion disposed on an end of a component designed to fasten into first open end 60. In various embodiments, other configurations of features on the ends of the barrel 1 may be used to secure other components to the barrel 1.

In various embodiments, several first end apertures 6 up to a plurality of first end apertures 6 are circumferentially disposed around the barrel 1 proximate to the first open end 60, through the entire thickness of the barrel wall. Similarly, second open end 70 comprises at least one second end aperture 7 disposed proximate to the second open end 70. In various embodiments, several second end apertures 7 up to a plurality of second end apertures 7 are circumferentially disposed around the barrel 1 proximate to the second open end 70, through the entire thickness of the barrel wall. Second end apertures 7 can be sized and positioned to accept solid, softened, deformable or molten material, for example, from a portion of a component designed to fasten into second open end 70. Any number and configuration of first end apertures 6 and second end apertures 7 are within the scope of the present disclosure depending on the nature and configuration of the components to fit into the ends of barrel 1, such as if the components are hollow or solid, and what the materials of construction are. In various embodiments, depressions disposed on the inside surface of the barrel 1 can accommodate similarly sized protrusions disposed on an external surface of a connecting component. In other embodiments, protrusions on a connecting component may snap into complementary sized apertures in the barrel 1. In some embodiments, apertures can have an opening facing longitudinally out from the barrel 1 to accept a complementary feature from another component.

Still referring to FIG. 6, the barrel 1 further comprises a recess 4 shaped to accept a weighted insert. Depending on how the barrel 1 is fabricated, such as by the casting of metal, the recess 4 may be formed at the time the barrel is formed, or it may be fabricated into the barrel at any other time. The recess 4 can be of any shape, and can include any number of holes 5 to accommodate screws or other fasteners such as rivets used to secure the weighted insert into the recess 4. In some embodiments, threaded fasteners allow for a weighted insert to be removable from the recess 4 whenever desired, for example to exchange it for a heavier or lighter weighted insert of the same shape. In other embodiments, the weighted insert can be friction fit into the recess 4, such as for example, by a snap or press fit, obviating the need for holes 5. The depth of the recess 4 is configured to be substantially complementary to the thickness of the weighted insert, such as for example to hold the weighted insert substantially flush with the outer surface 205 of the barrel 1 when the weighted insert is secured therein.

As discussed above in the context of both a ball bat and barrel, the barrel 1 of FIG. 6 may further comprises raised ribs 43 or other raised structural elements disposed on the inner surface, some of which may or may not be visible through the recess 4 when the weighted insert is not present.

Figure 7:
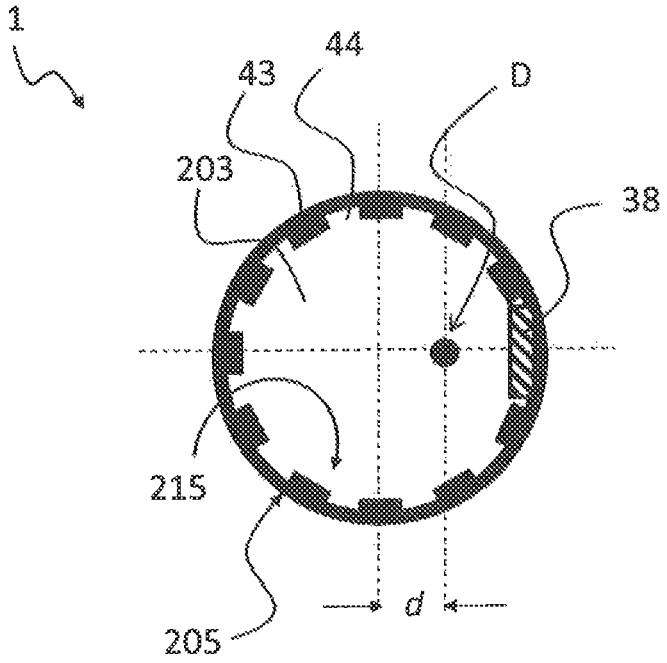
FIG. 7 illustrates a cross-sectional view of an embodiment of an unsymmetrically weighted barrel having a non-uniform cross-section in accordance with the present disclosure.

Referring now to FIG. 7, a cross-sectional view of an embodiment of an asymmetrically weighted barrel 1 in accordance with the present disclosure is illustrated. Barrel 1 comprises a cavity 203, an inner surface 215 and an outer surface 205. A plurality of raised ribs 43 are disposed on the inner surface 215 projecting into the cavity 203. As such, the barrel 1 has a non-uniform wall thickness. In various other embodiments, the barrel 1 may not have internal structural elements and may have a uniform wall thickness. For the embodiment depicted in FIG. 7, the barrel 1 comprises a weighted insert 38 mounted for example into a recess disposed in the outer surface 205 of the barrel 1.

As discussed above, the presence of a weighted insert 38 results in asymmetrical weighting of the barrel 1. In this case, the weighted insert 38 shifts the center-of-gravity of the barrel 1 to D, a shift from the central axis by a distance d toward the weighted insert 38. This illustrated embodiment thus features (a) stiffening due to the raised ribs 43; (2) a lighter design than a thicker cast or wrought metal barrel due to the presence of the recessed interstices 44 that equate to thinner wall regions; and (3) asymmetrical weighting due to the presence of the weighted insert 38.

Figure 8:
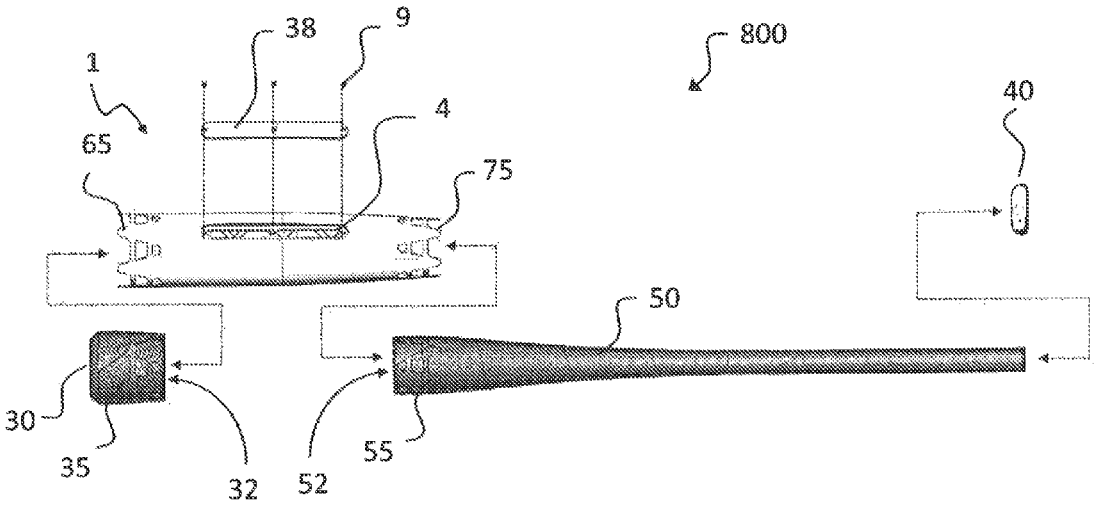
FIG. 8 illustrates an exploded view of an embodiment of a bat assembly in accordance with the present disclosure.

Referring now to FIG. 8, a bat assembly 800 in accordance with the present disclosure is illustrated. The bat assembly comprises a barrel 1, an end cap 30 and a handle 50. In various embodiments, the bat assembly 800 further comprises an end knob 40. In some embodiments, the barrel 1 can be the barrel depicted in FIGS. 1-3 and 6-7, with or without surface elements on the inner surface. The end knob 40 may be integral with the handle 50 rather than attached as a separate component.

Still referring to FIG. 8, bat assembly 800 further comprises a weighted insert 38 that can be reversibly or irreversibly attached into a recess 4 disposed in the barrel 1, and/or in any other component of the bat assembly 800. The weighted insert 38 may be fabricated of any metal, plastic or composite material. In various embodiments, the weighted insert 38 may comprise tungsten. The mass of the weighted insert 38 can be from about 50 grams to about 500 grams. In various embodiments, the weighted insert 38 has a mass of from 150 grams to about 200 grams. In various embodiments, the weighted insert 38 has a mass of around 170-180 grams. In various embodiments, the weighted insert 38 weighs about 179 grams. The weighted insert 38 may be secured into the recess 4 with any number of screws 9 or other suitable fasteners. As discussed above, in various embodiments the weighted insert 38 is fabricated to have complementary shape and dimensions to the recess 4 such that the weighted insert 38 can sit flush into the recess 4 when secured therein.

Still referring to FIG. 8, the end cap 30, handle 50 and end knob 40 may be constructed of any material, including for example, metals, carbon fiber, plastics or composites. In various embodiments, the barrel 1 comprises cast metal, such as for example, cast aluminum. In various embodiments, the end cap 30 and handle 50 comprise carbon fiber. A handle 50 comprising carbon provides desired stiffness at a lower weight, excellent damping, and complies with the new BBCOR specifications. An end cap 30 comprising carbon helps lower the overall moment of inertia ("MOI") value as weight positioned at the end of the bat is the most critical and helps create a "tamper proof" bat for compliance with the ABI standards. In various embodiments, any of these components may be constructed from injection molded plastics, such as for example, Torlon®.

With further reference to FIG. 8, the end cap 30 has external surface detailing 35 circumferentially disposed around an end 32 that can coordinate with complementary features 65 disposed around a larger open end of the barrel 1. In this way, the end 32 of the end cap 30 can be securely fastened into the larger open end of the barrel 1, with the features 65 locking into the surface detailing 35. Similarly, features 75 are disposed around a smaller open end of the barrel 1 that can lock into complementary surface detailing 55 disposed around an end 52 of the handle 50. When the end 52 of the handle 50 is inserted into the larger open end of the barrel 1, the features 75 can lock into the external surface detailing 55 on the handle 50.

In various embodiments, the male/female type connection between the end cap 30 and the larger open end of the barrel 1, and the male/female type connection between the handle 50 and the smaller open end of the barrel 1, can be strengthened by any means necessary to ensure the safety, tamperproof characteristics, integrity and performance of the bat assembly 800. For example, the connections between components can be secured with any combination of tight friction fit, locking arrangements (e.g. protrusion snapping into a complementary slot, recess or aperture), adhesives, and heating. Through use of these methods, the bat assembly 800 can be made tamperproof, discouraging modification when in sporting use.

In various embodiments, the weight of the end cap 30 can be from about 40 grams to about 70 grams, such as for example, about 57 grams. The weight of the barrel 1, without the weighted insert 38, can be from about 250 grams to about 500 grams, such as for example, about 283 grams. The weight of the handle 50 can be from about 250 to about 500 grams, such as for example, about 274 grams. The weight of an end knob 40 can be from about 1 to about 50 grams, such as for example, about 21.7 grams. The weight of three screws 9 can be from about 0.5 to about 1 gram, such as for example, about 0.7 grams.

Given these weights for the various components, bat assembly 800 can be targeted to weigh about 815 grams (about 28.75 oz.) in total. With a bat length of about 33 inches, the MOI for the bat assembly 800 is about 9,250 oz-in$^2$. The current NCAA minimum MOI is 8,538 oz-in$^2$. In regards to the present disclosure, MOI is readily changed by switching out the weighted insert 38 with other weights.

Thus in various embodiments, the asymmetrical weighting of bat assembly 800 is adjustable by changing to a weighted insert 38 of different weight. Given the ranges in weight for the weighted insert 38 and the barrel 1 discussed, d (in FIG. 7) can be from about 0.25 inches to about 0.75 inches. For a specific embodiment that includes a barrel 1 of cast metal weighing of about 283 grams, and a weighted insert 38 weighing of about 179 grams, d will be about 0.44 inches. Since the weight of the barrel 1 is fixed, location of the center of gravity can be adjusted as needed for a particular situation during play by switching out the weighted insert 38 for another weight.

Use of various weights can be "pitcher specific," changed to accommodate a particular ball pitcher in the game, or "situation specific," changed to make a particular hit as needed in a game. As discussed in more detail below, players using a ball bat in accordance with the present disclosure can now rotate and position the bat to place a specific spin and trajectory on the struck ball, depending upon the particular circumstances during the game.

Figure 9:
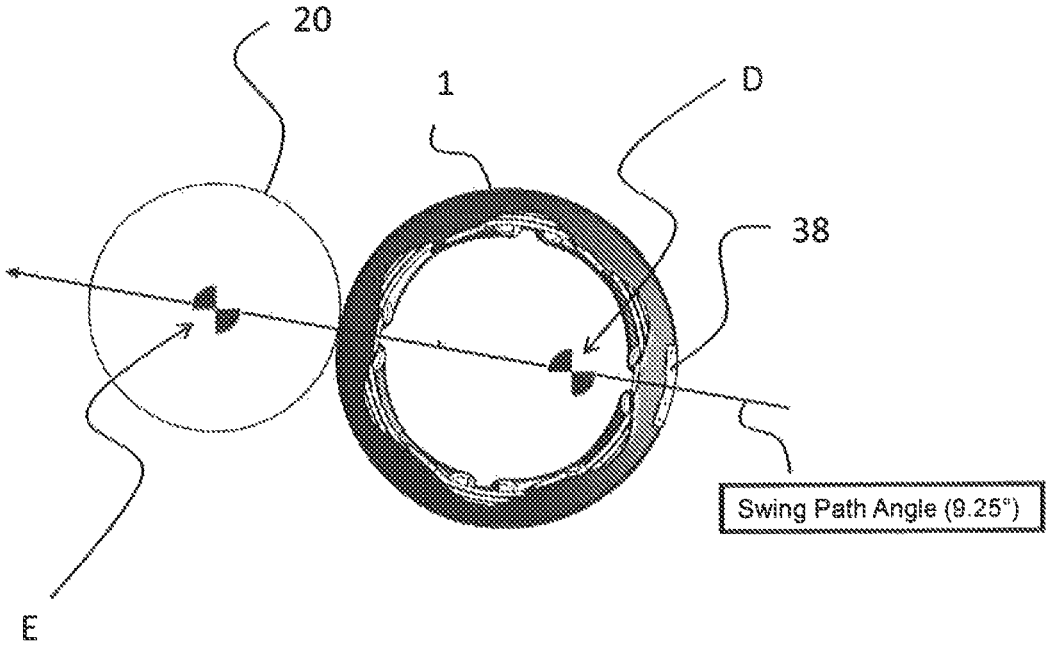
FIG. 9 illustrates the striking of a ball with an embodiment of an unsymmetrically weighted bat in accordance with the present disclosure.
Figure 10:
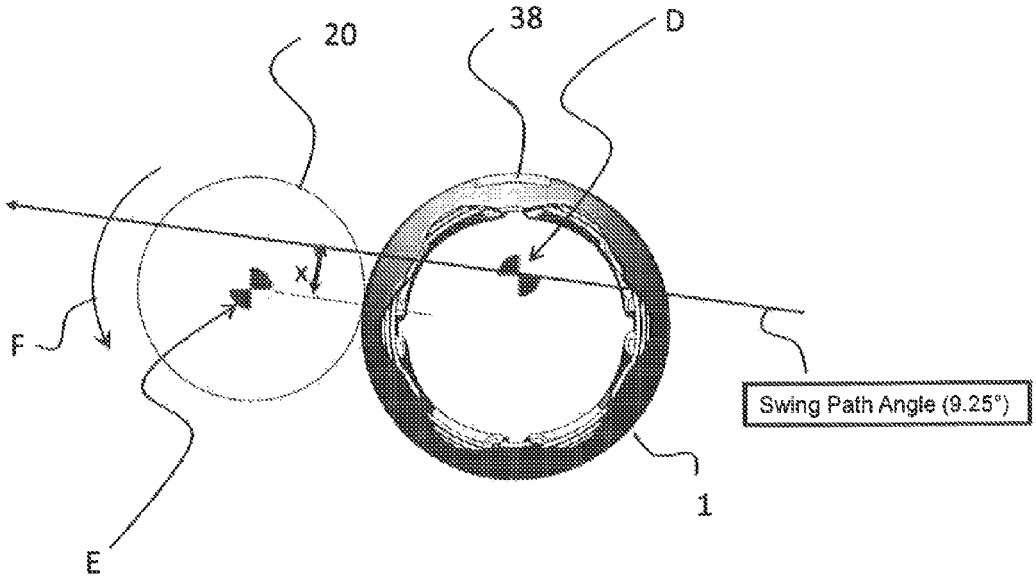
FIG. 10 illustrates the generation of topspin on a ball struck with an embodiment of an unsymmetrically weighted bat in accordance with the present disclosure.
Figure 11:
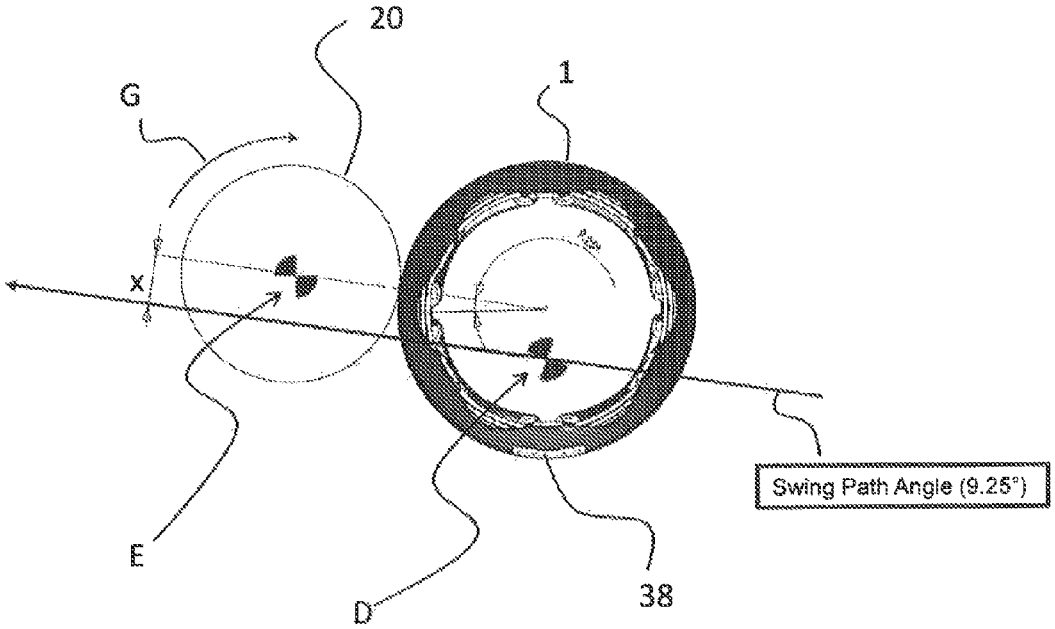
FIG. 11 illustrates a method of producing backspin on a ball struck with an embodiment of an unsymmetrically weighted bat in accordance with the present disclosure.

FIGS. 9, 10 and 11 illustrate the various ways an asymmetrical bat can be angularly orientated to produce various spin effects and trajectories for a struck ball. FIGS. 9, 10 and 11 show cross-sections of three possible impact positions and the resulting change in center-of-gravity alignment that these scenarios produce. The use of a weighted insert 38 as discussed above allows the bat to have adjustable MOI profiles, balance point (BP), and spin characteristics, all through center-of-gravity manipulation.

When referring to FIGS. 9, 10 and 11, it is understood that the term "asymmetrical bat" or "asymmetrically weighted bat" broadly refer to any one of: (i) a ball bat having a weighted insert recessed into a portion of it; (ii) a ball bat having a thicker wall segment; (iii) a bat assembly comprising an asymmetrically weighted barrel having a weighted insert recessed into a portion of the barrel; and (iv) a bat assembly comprising an asymmetrically weighted barrel having a thicker wall segment in the barrel.

As a background, the loss of high rebound velocity thin-walled bats in the games of baseball and softball due to new regulations has reduced the number of home runs and has created a corresponding need to score runs through what is commonly referred to as "small ball." Small ball is a strategy in baseball and softball that focuses on singles, walks, base hits, and bunts to score runs, a strategy that ultimately requires the batter to increase the odds of hitting a ground ball (e.g., in a hit and run situation) or a fly ball (e.g., for a sacrifice fly to score or move a runner), when needed.

Referring now to FIG. 9, the effect of striking the ball with an asymmetrically weighted bat held in a neutral position is illustrated. The cross section of the barrel 1 shows that the weighted insert 38 is positioned opposite the ball 20 to be struck. During play, the batter would hold the asymmetrically weighted bat such that the weighted insert 38 is pointing behind home plate. In this way the ball 20 will be struck with an outer face of the bat opposite the weighted insert 38. The center-of-gravity "D" of the barrel 1 and center-of-gravity "E" of the ball 20 align on an axis tilted 9.25° from horizontal, representing a typical swing path angle of the bat. With the ball 20 struck in this manner, no additional "CG-induced" spin will be imparted and the trajectory of the ball 20 will be 9.25° from horizontal out into the playing field. Additionally, if the ball 20 is struck against the weighted insert 38, (i.e., with the weighted insert 38 oriented toward the pitcher), a "dead bat" (i.e. less rebound velocity) bunt having no spin will result.

Referring now to FIG. 10, topspin "D" can be imparted on the ball 20 when the bat is held in the angular orientation where the weighted insert 38 is on top of the bat during impact. Traditionally, to put topspin on the ball, and to hit a groundball rather than a fly ball, the ball would need to be struck off the bottom of the bat, a situation that produces poor rebound velocity. On the other hand, with an asymmetrically weighted bat, the center of the ball 20 can be squarely struck, yet topspin can still be generated because of the angular orientation of the weighted insert 38. As illustrated in FIG. 10, a swing path angle of 9.25° fails to align the center-of-gravity of the bat "D" with the center-of-gravity of the ball "E." The CG's are "misaligned" by a distance "x," such as by 0.44 inches as discussed above, generating topspin on the struck ball and the likelihood of a ground ball.

Referring now to FIG. 11, backspin "G" can be imparted on the ball 20 when the bat is held in the angular orientation where the weighted insert 38 is at the bottom of the bat during impact. Traditionally, to put backspin on the ball, and to hit a fly ball rather than a groundball, the ball would need to be struck off the top of the bat, a situation that produces poor rebound velocity. On the other hand, with an asymmetrically weighted bat, the center of the ball 20 can be squarely struck, yet backspin can still be generated because of the angular orientation of the weighted insert 38. As illustrated in FIG. 11, a swing path angle of 9.25° fails to align the center-of-gravity of the bat "D" with the center-of-gravity of the ball "E." The CG's are "misaligned" by the distance "x," such as by 0.44 inches as discussed above, generating backspin on the struck ball and the likelihood of a fly ball.

As illustrated in FIGS. 9-11, control over the spin and trajectory of the struck ball is possible even when impacting the ball squarely with maximum efficiency. By controlling the angular orientation of a weighted insert when striking the ball, the batter controls whether to impart no spin, topspin or backspin on the ball, and can help choose whether to hit a groundball or a fly ball, or to bunt the ball.

FIGS. 9-11 should not be construed as inferring that there may be only three angular orientations in which an asymmetrically weighted bat of the present disclosure can be used. Actually, there are an infinite number of angular orientations for an asymmetrically weighted bat. Furthermore, there are an infinite number of ways to strike the ball rather than squarely. Thus, there are infinite combinations of bat orientation, ball-bat alignment, and swing angle.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

Likewise, numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the disclosure, to the full extent indicated by the broad, general meaning of the terms in which the appended claims are expressed. To the extent that these various modifications do not depart from the spirit and scope of the appended claims, they are intended to be encompassed therein.

What is claimed is:

1. A bat comprising:

a barrel having a wall with at least one receiving aperture at each of a first open end and a second open end;

a longitudinally non-uniform wall thickness;

an off-center weight encapsulated within a barrel impact region of a wall of the barrel, the off-center weight having a density different than the wall of the barrel that creates an asymmetric center of gravity position localized in the barrel impact region;

a handle affixed to the barrel by extending into the at least one receiving aperture at the first open end; and an end cap affixed to the barrel by extending through the at least one receiving aperture proximate the second open end.

2. The bat of claim 1, further comprising structural elements disposed on an inner surface of the barrel.

3. The bat of claim 2, wherein the structural elements comprise non-longitudinal raised ribs and recessed interstices.

4. The bat of claim 1, wherein the barrel comprises at least one of a non-metal and a metal.

5. The bat of claim 1, further comprising several first end apertures disposed circumferentially around the barrel proximate to the first open end and several second end apertures disposed circumferentially around the barrel proximate to the second open end.

6. The bat of claim 4, wherein the barrel comprises at least one of aluminum, magnesium, titanium, composite and plastic.

7. The bat of claim 3, wherein the recessed interstices have a uniform wall thickness.

8. The bat of claim 1, further comprising an end knob disposed on said handle.

9. The bat of claim 1, wherein the barrel comprises a hollow monolithic cast metal material.

10. The bat of claim 9, wherein at least one of the end cap and handle comprise a carbon fiber material.

* * * * *